US008939230B2

(12) United States Patent
Boehm et al.

(10) Patent No.: US 8,939,230 B2
(45) Date of Patent: Jan. 27, 2015

(54) MULTIPURPOSE HITTING DEVICE WITH A MECHANISM FOR ABSORBING THE ENERGY TRANSMITTED TO THE GRIPPING MEANS

(75) Inventors: Jean-Louis Boehm, Chamboeuf (FR); Arnaud Drevon, Lyons (FR)

(73) Assignee: Etablissements Boehm et Cie, La Fouillouse (FR)

( * ) Notice: Subject to any disclaimer, the term of this patent is extended or adjusted under 35 U.S.C. 154(b) by 805 days.

(21) Appl. No.: 13/140,910

(22) PCT Filed: Nov. 4, 2009

(86) PCT No.: PCT/FR2009/052127

§ 371 (c)(1),
(2), (4) Date: Oct. 6, 2011

(87) PCT Pub. No.: WO2010/072931

PCT Pub. Date: Jul. 1, 2010

(65) Prior Publication Data

US 2012/0024554 A1 Feb. 2, 2012

(30) Foreign Application Priority Data

Dec. 22, 2008 (FR) ..... 08 58951

(51) Int. Cl.
*B25D 1/02* (2006.01)
*B25D 1/12* (2006.01)
(Continued)

(52) U.S. Cl.
CPC ... *B25D 1/12* (2013.01); *B25F 1/00* (2013.01); *B25D 1/02* (2013.01); *B25G 1/01* (2013.01); *B25H 7/045* (2013.01)
USPC ..... 173/162.2; 173/90; 173/121; 227/134; 227/147

(58) Field of Classification Search
CPC ..... B25D 1/00; B25D 1/02; B25D 1/04; B25D 1/045; B25D 1/14; B25G 1/00; B25G 1/08; B25G 3/00; B25G 3/08; B25C 1/02; B25C 3/008; B25C 7/00; B25F 1/00; B25F 1/02
USPC ..... 227/134, 147, 148, 110; 81/20, 21, 22, 81/25, 27, 439; 7/143, 144, 165; 173/90, 173/121, 162.1, 162.2, 170
See application file for complete search history.

(56) References Cited

U.S. PATENT DOCUMENTS 1,045,145 A * 11/1912 Hubbard ..... 81/22
2,490,684 A * 12/1949 Gosselin ..... 30/277

(Continued)

FOREIGN PATENT DOCUMENTS

EP 0008574 B 4/1983
FR 2431352 A1 2/1980

(Continued)

OTHER PUBLICATIONS

International Search Report for PCT/FR2009/052127 dated Jan. 25, 2010.

*Primary Examiner* — Scott A. Smith
(74) *Attorney, Agent, or Firm* — Heslin Rothenberg Farley & Mesiti P.C.

(57) ABSTRACT

A tool has a mechanism for absorbing energy transmitted to a hand grip, comprising a support body, a handle, an elastic return member and an interchangeable head as a base unit which is capable of accommodating additional fittings depending on the specific application. A lower part of the cylindrical body has a shouldered part having a diameter larger than its upper part so as to allow positioning and support of a ring associated with the handle. The handle has an internal shouldered part with an upper face constituting the support for the elastic return member. The interchangeable striking head comprises a part centered in the ring and a neck that fits inside an internal bore of the body. The striking head rests directly on the body in order to transmit the entire striking force to the body, and the handle extends rearwardly as the hand grip.

10 Claims, 5 Drawing Sheets

(51) Int. Cl.

| | |
|---|---|
| ***B25F 1/00*** | (2006.01) |
| ***B25G 1/01*** | (2006.01) |
| ***B25H 7/04*** | (2006.01) |

(56) References Cited

U.S. PATENT DOCUMENTS

| | | | | | |
|---|---|---|---|---|---|
| 2,643,379 | A | * | 6/1953 | Matovich | 227/147 |
| 2,664,820 | A | * | 1/1954 | Brown, Jr. | 101/405 |
| 2,768,376 | A | * | 10/1956 | Critchley | 173/31 |
| 3,012,247 | A | * | 12/1961 | Sillars et al. | 227/121 |
| 3,060,440 | A | * | 10/1962 | De Caro et al. | 227/147 |
| 3,060,441 | A | * | 10/1962 | Henning | 227/147 |
| 3,112,488 | A | * | 12/1963 | Dettloff et al. | 227/127 |
| 3,711,008 | A | * | 1/1973 | Clifford et al. | 227/147 |
| 4,448,339 | A | * | 5/1984 | Pettigrew | 227/147 |
| 4,519,536 | A | * | 5/1985 | Steigauf | 227/147 |
| 4,924,576 | A | * | 5/1990 | Schiller | 30/358 |
| 5,282,564 | A | * | 2/1994 | Vigil Rio | 227/14 |
| 6,128,977 | A | | 10/2000 | Gierer et al. | |
| 6,532,614 | B2 | * | 3/2003 | Bloom | 7/105 |
| 6,564,681 | B2 | * | 5/2003 | Coulter | 81/487 |
| 6,598,775 | B1 | * | 7/2003 | Chen | 227/113 |
| 6,779,697 | B2 | * | 8/2004 | Lin | 227/120 |
| 6,928,899 | B1 | | 8/2005 | Lin | |
| 6,951,153 | B2 | * | 10/2005 | Berthlaume | 81/44 |
| 7,287,680 | B2 | * | 10/2007 | Deziel | 227/110 |
| 7,316,342 | B2 | * | 1/2008 | Chen | 227/142 |
| 7,878,383 | B2 | * | 2/2011 | Marschel et al. | 227/148 |

FOREIGN PATENT DOCUMENTS

| | | | |
|---|---|---|---|
| FR | 2788459 | A1 | 7/2000 |
| FR | 2807692 | A1 | 10/2001 |

* cited by examiner

MULTIPURPOSE HITTING DEVICE WITH A MECHANISM FOR ABSORBING THE ENERGY TRANSMITTED TO THE GRIPPING MEANS

CROSS REFERENCE TO RELATED APPLICATIONS

This application is a national stage filing under section 371 of International Application No. PCT/FR2009/052127 filed on Nov. 4, 2009, and published in French on Jul. 1, 2010 as WO 2010/072931 and claims priority of French application No. 0858951 filed on Dec. 22, 2008, the entire disclosure of these applications being hereby incorporated herein by reference.

BACKGROUND ART

The invention relates to the technical field of hand-held striking tools that can be used for different purposes. These are simple striking tools used to drive any product into a substrate made of various materials. They can be tools for marking a product. They can be biscuit-cutter type cutting tools.

They are also known to be used for other functionalities, for example tightening and untightening, and to have hand wrenches and, more precisely, socket wrenches that accommodate a range of sockets having various shapes, dimensions and contact areas capable of ensuring tightening and untightening under the right conditions.

The invention is specifically aimed at hand-held striking tools which still pose numerous problems.

First of all, there is the problem of safety when striking a blow and preventing injury to the operator's hand which may involve, for instance, using a guard made of an elastomer material, as described in Patent FR 2431352, for the hand-held striking tool. This type of guard is widely used and affords protection if the tip of the striking tool slips. This type of guard is useful but its use remains limited to one specific usage.

Another problem is deterioration of the striking head of these types of hand-held striking tools in the various applications mentioned above, which are not limitative, and which requires complete replacement of the tool.

Despite certain surface treatments, the striking head of the tools deteriorate and this makes slipping and therefore injuries more likely. Because of this, if there is excessive deterioration, the only solution is to replace the entire tool and this incurs costs.

Another problem is recoil and vibration of the tool after striking it due to the counteracting force produced by the striking force which may cause inaccurate striking and accidents. This phenomenon can be awkward for the user and troublesome, especially in terms of muscle strain.

Faced with these various problems which are always closely associated with cumulative unwanted effects, the Applicant's approach was therefore to try and devise a new type of hand-held striking tool that would be safer for the operator, adaptable, depending on the needs and applications in question, and with a removable striking head that could be replaced and/or disposed of, depending on the means of striking and deterioration of the impact area.

Another sought-after object was to improve the operator's physical safety by moving the handhold away from the body of the tool, thus moving it away from the impact area.

Having conducted various research work that took into account all the above-mentioned constraints, a solution that resolves the various aforementioned problems was devised.

BRIEF SUMMARY OF INVENTION

Thus, the multipurpose striking tool is distinctive in that it comprises a mechanism for absorbing the energy transmitted to the gripping means, said mechanism comprising four main elements, namely a support body, a handle, an elastic return means and an interchangeable head, these four elements being assembled to provide a base unit which is then capable of accommodating additional means that fit on to this unit, depending on the applications in question, and in that the lower part of the cylindrical body has a shouldered part having a diameter that is larger than its upper part so as to allow positioning and support of an associated ring designed with a handle part, and in that the handle is designed with an internal shouldered part, whereof the upper face constitutes the support for the elastic means whose function is to absorb the energy transmitted to the handle, thus limiting vibration, and in that the interchangeable striking head comprises a part that is centred in the ring and a neck that engages in an internal bore of the body, and in that said striking head rests directly on the body in order to transmit the entire striking force to it, and in that the handle extends rearwardly as an arm.

These aspects and others will become apparent from the rest of the description.

BRIEF DESCRIPTION OF DRAWING FIGURES

The object of the present invention is described, merely by way of example, in the accompanying drawings in which.

DETAILED DESCRIPTION

In order that the object of the invention may more readily be understood, the following description is given, merely by way of example, reference being made to the accompanying drawings.

Figure 1:
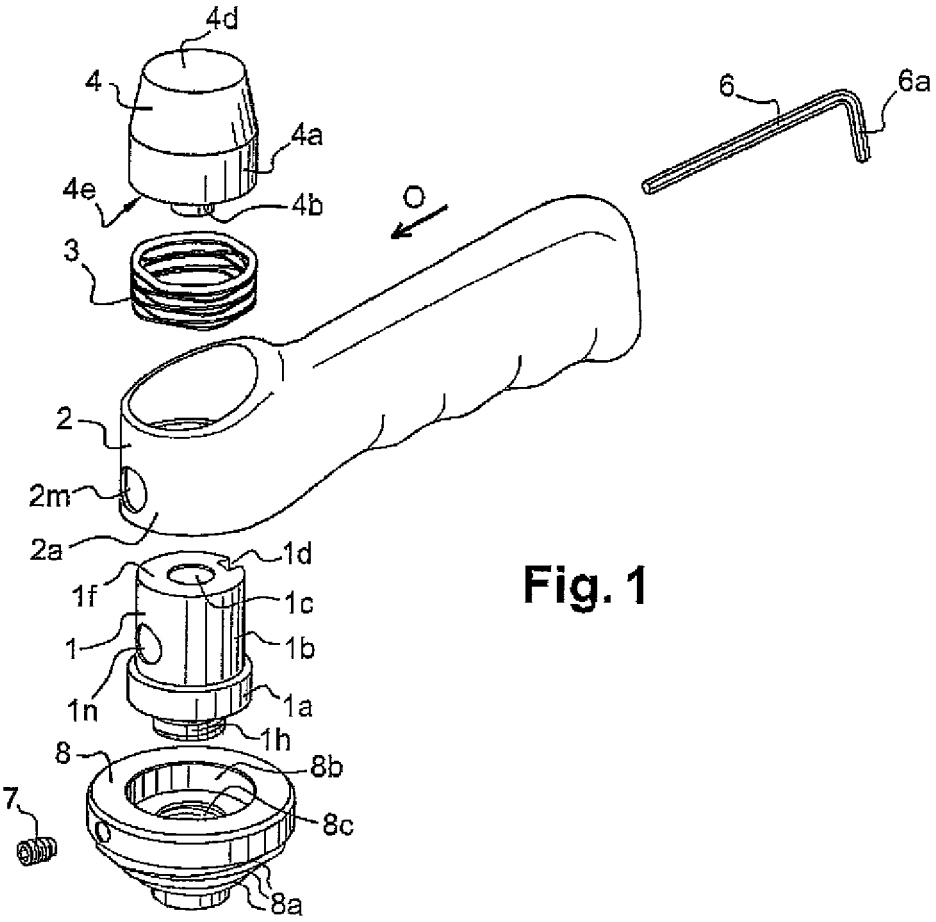
FIG. 1 is an exploded perspective view of the component parts of the striking tool, before assembly, comprising the energy absorbing mechanism with its essential component parts before an appropriate tool, depending on the application in question, is fitted, in this case a chuck for a biscuit-cutter is shown by way of example.
Figure 2:
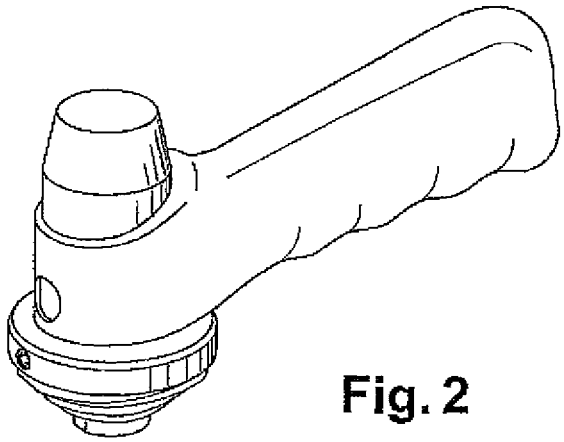
FIG. 2 is a perspective view of the striking tool according to the invention when it is used as a biscuit-cutter.
Figure 3:
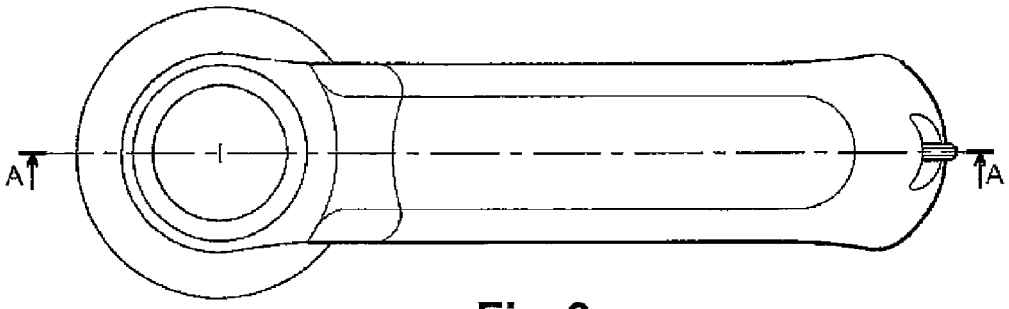
FIG. 3 is a top view of the tool as in FIG. 2.
Figure 4:
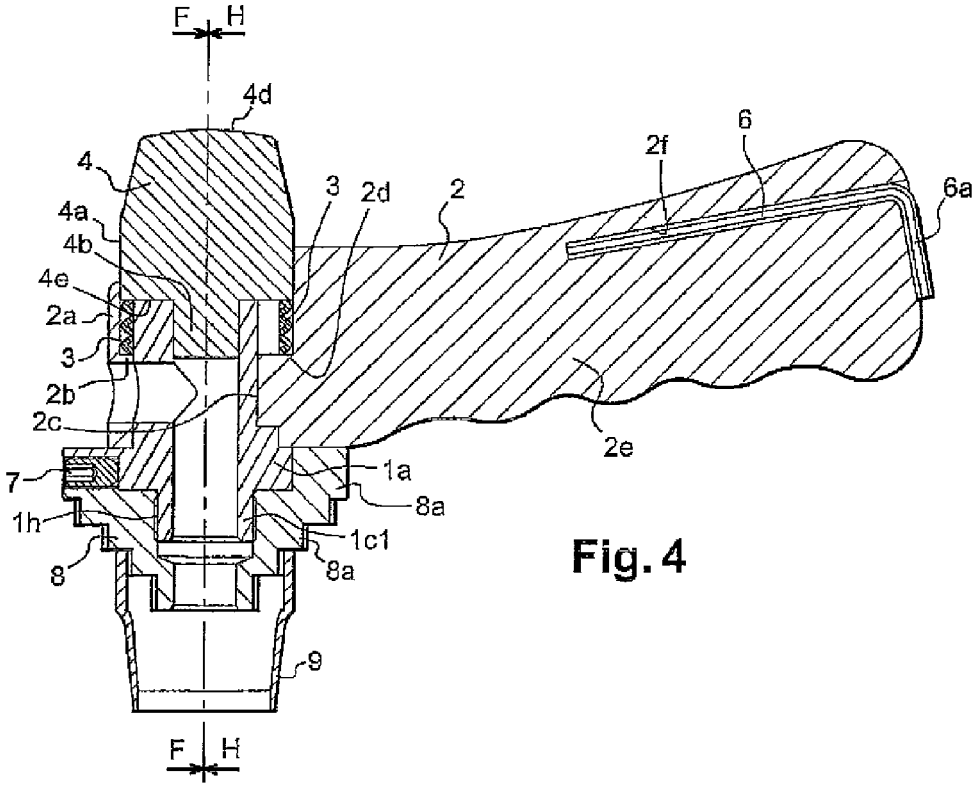
FIG. 4 is a cross-sectional view of the assembled version of the hand-held striking tool, with a biscuit-cutter fitted, along line A-A in FIG. 3.
Figure 5:
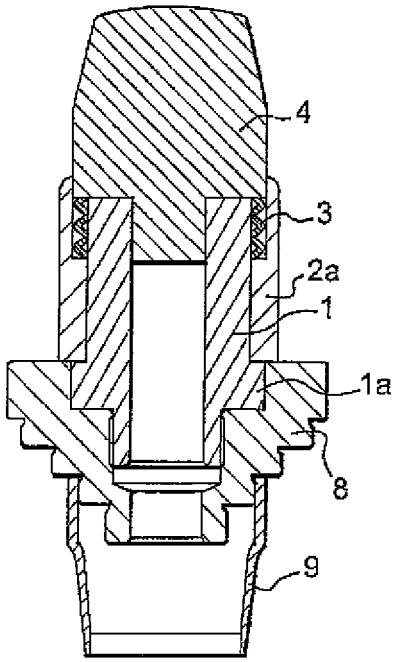
FIG. 5 is a cross-sectional view along line F-F in FIG. 4.
Figure 6:
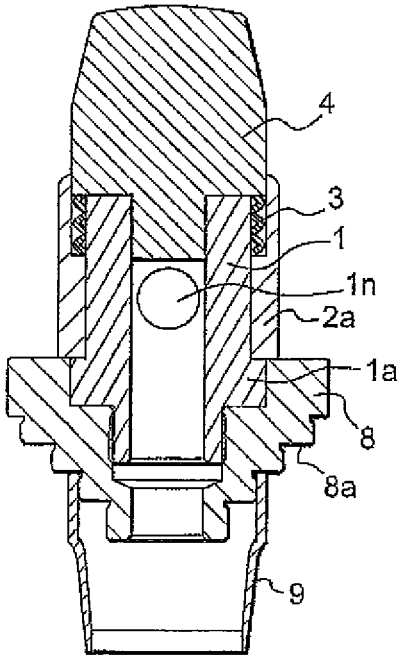
FIG. 6 is a cross-sectional view along line H-H in FIG. 4.
Figure 7:
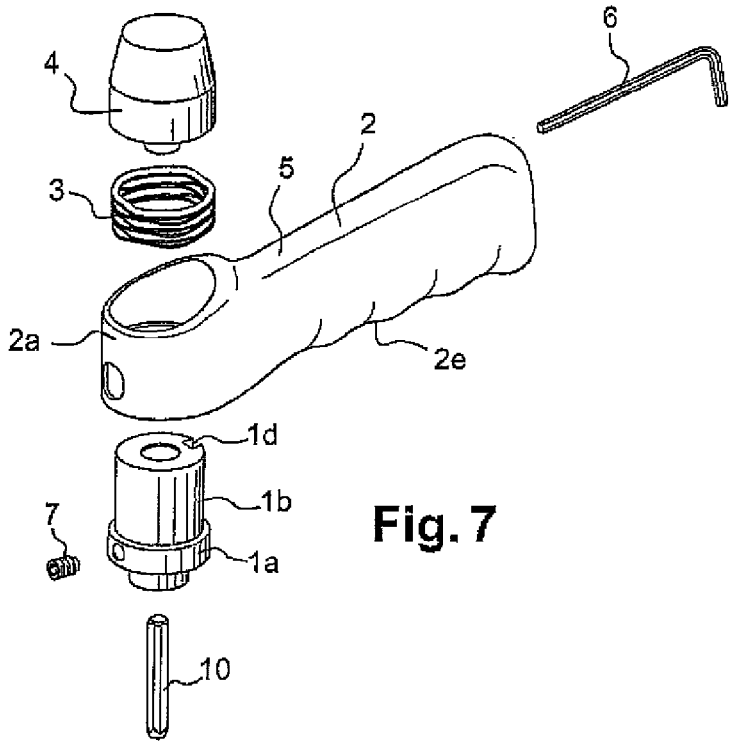
FIG. 7 is an exploded perspective view of the striking tool according to the invention when it is used for marking.
Figure 8:
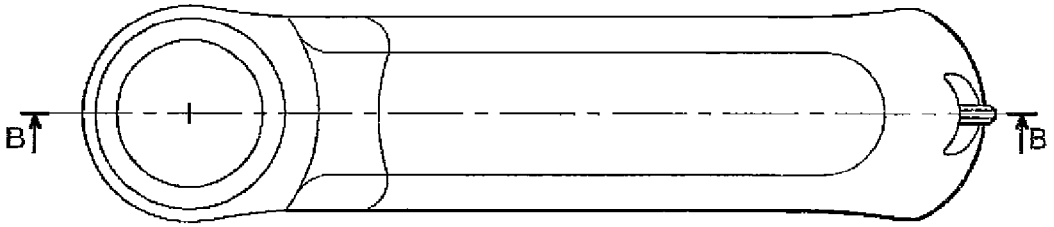
FIG. 8 is a top view of the tool as in FIG. 7.
Figure 9:
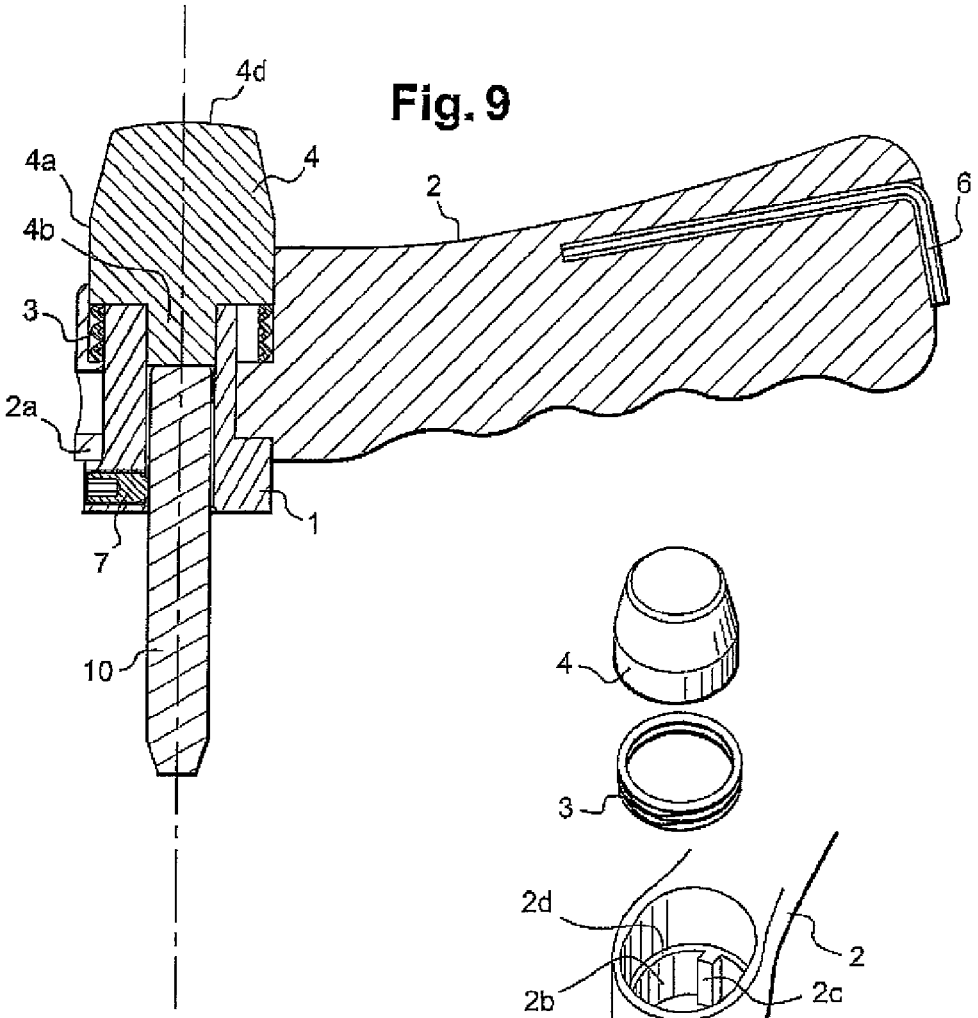
FIG. 9 is a cross-sectional view of the assembled version of the hand-held striking tool along line B-B in FIG. 8.
Figure 10:
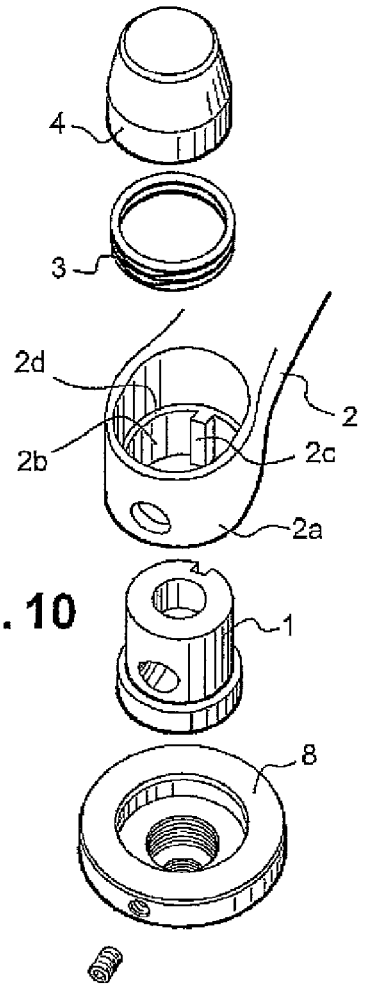
FIG. 10 is an exploded top perspective view showing the biscuit-cutter version of the hand-held striking tool, by way of example, in order to illustrate how it is assembled.

The multipurpose striking tool according to the invention is referred to in its entirety as (O) and comprises a mechanism that absorbs the energy transmitted to the gripping means. This mechanism comprises four main elements, namely a support body (1), a handle (2), an elastic return means (3) and an interchangeable head (4), these four elements being assembled to produce a base unit and then being capable of accommodating additional means that fit on to this unit depending on the applications in question. FIG. 1 illustrates the above-mentioned base unit with a biscuit-cutter chuck fitted by way of example.

The striking tool comprises a cylindrical body (1) which, in its lower part, has a shouldered part (1*a*) whose diameter is greater than that of upper part (1*b*) in order to allow positioning and support of an associated ring (2*a*) shaped with the handle part. Cylindrical body (1) has a through bore (1*c*), with shouldered part (1*a*) having a diameter that is substantially greater than part (1*c*1) underneath it. In addition, body (1) has a groove (1*d*) over the entire height of part (1*b*) which fulfils an anti-rotation function as explained below. The body is made of any appropriate material.

Handle part (2) comprises a ring (2*a*) for centring and attachment to the body and is internally designed with an internal shoulder (2*b*) and a spline (2*c*) that is capable of penetrating into groove (1*d*) formed on the body. Internal shouldered part (2*b*) therefore surrounds the upper part (1*b*) of body (1) and, on its upper horizontal face (2*d*), defines a support surface for elastic means (3) that fulfils the function of absorbing energy transmitted to the handle, thereby limiting any vibration.

Handle (2) extends rearwardly as a hand grip (2*e*), including, if applicable, a support area (5) made of a flexible material that provides a comfortable hold for the operator's hand in the case of a hand-held version. This handle therefore creates a gripping part that is distant from body (1) and striking head (4), thus eliminating or significantly reducing the effects of vibration at the time when a blow is struck. In a version of the striking tool that is designed for automated use, hand grip part (2*e*) can be grasped by any gripping means. Handle (2) is, for example, of one-piece construction and is made of any appropriate material that ensures flexibility, comfort and an ergonomic grip. Along its length, hand grip (2*e*) of the handle may have one or more compartments (2*f*) to accommodate an offset Allen key which cooperates with means of screw fastening and attachment (7) that will be explained later on.

Elastic means (3) is, for example, of the wave-spring or helical-compression spring type or any equivalent means of the elastomer ring type which fulfils the same compression function. Elastic means (3) rests on bearing surface (2*d*) of the ring of the handle. Striking head (4) which is designed to be interchangeable in order to allow for its deterioration, comprises a middle part (4*a*) that is centred in ring (2*a*) and rests on and is compressed against elastic means (3). Striking head (4) also comprises a cylindrical neck (4*b*) capable of fitting into the internal bore (1*c*) of body (1). Said head therefore elastically presses against energy-absorbing means (3) and its face (4*e*) rests on upper face (1*f*) of the body. This way, the striking head rests directly on the body in order to transmit the entire striking force. Upper part (4*d*) of the head undergoes, for instance, a surface treatment than enables it to withstand blows struck by a club hammer or similar tool. This interchangeable head concept makes it possible to provide a range of heads, each having different technical characteristics.

To prevent accidental escape of the striking head, the latter may be secured in ring (2*a*) of the handle with a certain freedom of movement by resting on the elastic means while being secured at the top by a retention clip. The striking head can nevertheless be removed when it needs to be changed.

It is emphasised that, when a blow is struck, the vertical acceleration to which the body (1) and head (4) assembly is subjected causes compression of elastic means (3) and hence movement relative to ring (2*a*) of handle (2).

Having described the basic principles of the striking tool, two examples of an application of the invention are described below, merely by way of example and not limitatively, making reference to the accompanying drawings.

The first application of the invention is biscuit-cutters that are used to cut out discs, pads or rounds, for example, from blanks made of metal or other materials.

The striking tool then includes three additional parts, namely a chuck (8) which fits on and attaches to shouldered part (1*a*) formed on the body and one or more connecting screws (7) that ensure(s) radial clamping of the assembly. The chuck is of the same type as that disclosed in the Applicant's Patent FR 2807692. The chuck comprises a plurality of steps (8*a*) having tapering-diameter matching shapes described in this patent and used in order to attach a cutting tool (9) which is known in itself.

In one implementation, for example, chuck (8) is screwed onto the body allowing, firstly, its hollow central upper part (8*b*) to fit around cylindrical bearing surface (1*a*) with a connecting screw (7) and, secondly, enabling the profiled end (1*h*) to be screwed into internal thread (8*c*) provided in the chuck for this purpose.

Because of the nature of the application, openings (1*n*) and (2*m*) for the removal of waste off cuts are provided both on body (1) and on ring (2*a*) of the handle. These off cuts actually travel through the body upwards and are removed radially. The way in which openings (1*n*) and (2*m*) are oriented will depend on the striking tool's application.

As far as the second marking application is concerned, the cylindrical body internally accommodates a marking tool (10), the end of which has the mark. One or more screws (7) located in the shapes on the extreme shouldered part (1*a*) of the body ensure positional tightening.

Without extending beyond the scope of the invention, the body can be designed to suit specific applications. For example, the body can be modified to allow movement of a rod when using a cutting compass (Patent FR 2788459).

The advantages are readily apparent from the description. The multipurpose capability of the striking tool comprising a mechanism for absorbing energy transmitted to the gripping means, its adaptability in order to meet specific needs, improved operator safety with the handhold and gripping generally being moved away from the impact area by the handle are all emphasised. The interchangeability of the striking head as required and depending on its surface condition is also underlined.

The virtual elimination of absorbed vibration transmitted to the operator's hand is also emphasised because the hand is located further from the impact zone.

Another important advantage of the invention, especially in the biscuit-cutter application, is the fact that the moving mass is reduced thanks to positioning the tool's handhold further away. Consequently, the force transmitted to the tool is greater thanks to this layout.

Also, the elimination or virtual elimination of vibration makes it possible to obtain better quality cutting or marking because rebound of the support surface for the biscuit-cutter or marking means on the substrate being worked on is limited. The efficiency with which vibration is damped is not linked to the force exerted to grip the tool in the hand.

This also produces better gripping of the assembly when a blow is struck. The materials from which the components of the tool are made are chosen depending on the particular application.

Finally, one indirect but practical advantage of the tool is emphasised—the ability to store Allen key (6), that is used to tighten and untighten the connecting screws, inside the hand grip of the handle with the key's shorter leg (6*a*) partially protruding and being recessed into the rear face of the handle.

The invention claimed is:

1. Multipurpose striking tool having a mechanism for absorbing energy transmitted to a gripping part, comprising a cylindrical support body having an internal axially extending bore, a handle including a ring at one end and a gripping part laterally spaced from the ring, an elastic return member and an interchangeable striking head, assembled as a base unit capable of accommodating additional fittings depending on a specific application, a lower part of the cylindrical support body having a shouldered part having a diameter larger than an upper part of the cylindrical support body to position and support the ring of the handle, the ring of the handle having an internal shouldered part, an upper face of the internal shouldered part supporting the elastic return member within the ring, the interchangeable striking head comprising a middle part centered in the ring and resting on the elastic return member, and a neck that fits inside the internal bore of the cylindrical support body, said striking head rests directly on the cylindrical support body in order to transmit an entire striking force to the cylindrical support body, whereby when the striking head is struck with a striking force, the elastic return member is compressed and the striking head and the cylindrical support body move relative to the ring of the handle, the elastic return member absorbing the energy transmitted to the handle, thus limiting vibration.

2. Multipurpose striking tool as claimed in claim 1, wherein the internal axially extending bore of the cylindrical support body comprises a through-bore, diameter of the shouldered part of the cylindrical support body being larger than a part underneath the shouldered part and the cylindrical support body has a groove over an entire height of the upper part which fulfils an anti-rotation function.

3. Striking tool as claimed in claim 2, wherein the handle comprises a spline, the spline penetrating into the groove on the cylindrical support body, and the internal shouldered part surrounds the upper part of the body and defines, on a horizontal upper face, a support plane for the elastic return member.

4. Striking tool as claimed in claim 1, wherein the handle comprises one or more compartments to accommodate an offset Allen key.

5. Striking tool as claimed in claim 1, wherein the elastic return member comprises a wave-spring or means that fulfils a compression function.

6. Striking tool as claimed in claim 1, wherein the striking head is interchangeable in order to allow for its possible deterioration, and comprises the middle part centered in the ring and supported and pressed against the elastic return member, and the neck is cylindrical and capable of fitting inside the internal bore of the cylindrical support body, and said striking head is elastically supported on the elastic return member and, on an upper face of the cylindrical support body.

7. Striking tool as claimed in claim 1, further including a chuck which fits on and is attached around the shouldered part of the cylindrical support body, one or more connecting screws which ensure a radial tightening of the chuck, and a cutting tool.

8. Striking tool as claimed in claim 7, further comprising openings on the cylindrical support body and on the ring of the handle for removal of waste off cuts.

9. Striking tool as claimed in claim 1, wherein for a marking application, the cylindrical support body internally accommodates a marking tool, having a marking end, and one or more screws located on an extreme flange of the cylindrical support body for ensuring positional tightening.

10. Striking tool as claimed in claim 1, wherein the gripping part of the handle is contoured to form a hand grip.

* * * * *